US007025131B2

(12) United States Patent
Baugh et al.

(10) Patent No.: US 7,025,131 B2
(45) Date of Patent: Apr. 11, 2006

(54) ELECTRICAL TUBING CONTROL AND REMEDIATION APPARATUS AND METHOD OF USE

(76) Inventors: Benton F. Baugh, 14626 Oak Bend, Houston, TX (US) 77079; James R. Crawford, 108 Copperwood Crossing, Lafayette, LA (US) 70598

( * ) Notice: Subject to any disclaimer, the term of this patent is extended or adjusted under 35 U.S.C. 154(b) by 62 days.

(21) Appl. No.: 10/655,315

(22) Filed: Sep. 5, 2003

(65) Prior Publication Data

US 2005/0051334 A1 Mar. 10, 2005

(51) Int. Cl.
*E21B 23/00* (2006.01)
*E21B 36/00* (2006.01)

(52) U.S. Cl. ..... 166/66.7; 166/66.6; 166/65.1; 166/317; 166/318; 166/373; 166/248; 166/302

(58) Field of Classification Search ..... 166/248, 166/302, 57, 65.1, 66.6, 66.7, 317, 318, 66.4, 166/373

See application file for complete search history.

(56) References Cited

U.S. PATENT DOCUMENTS 2,244,255 A * 6/1941 Looman ..... 166/302
2,982,354 A * 5/1961 Green ..... 166/60
4,716,960 A * 1/1988 Eastlund et al. ..... 166/60
4,790,375 A * 12/1988 Bridges et al. ..... 166/60
6,619,388 B1 * 9/2003 Dietz et al. ..... 166/66.7

* cited by examiner

*Primary Examiner*—David Bagnell
*Assistant Examiner*—G M Collins

(57) ABSTRACT

The method of operating a subsurface safety valve and preventing or remediating the formations of hydrate, wax, or paraffin solids in the well bore of an oil or gas well comprising coating the external area of the intermediate portion of a string of tubing to electrically insulate said intermediate portion of said string of tubing, inserting said surface control valve into a well bore pipe on a string of tubing, electrically grounding said surface control valve to said well bore pipe, communicating an electrical signal from the surface along said string of tubing, to said surface control valve, and along said well bore pipe back to said surface, closing said surface control valve upon the interruption of said electrical signal, and using the electrical resistance of said string of tubing to heat the wall of said string of tubing.

12 Claims, 5 Drawing Sheets

ELECTRICAL TUBING CONTROL AND REMEDIATION APPARATUS AND METHOD OF USE

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention is that of tools methods used to control the flow of oil and gas from wells and preventing the formation of hydrate, wax, and paraffin solids deposits in the bore of the oil or gas wells. Oil and gas wells are drilled into the surface of the earth at depths from a few hundred feet to tens of thousands of feet, both on land and in the offshore environment.

Hydrates are formed when mixtures of methane gas combine with water and form a type of crushed ice which can block the bore of the tubing coming up out of the well bore. Temperature and pressure conditions have to be in a range to allow the formations to occur. If the required range of temperatures and pressures can be avoided, the hydrates will not form.

Waxes or paraffins form when hot or warm oil containing waxes or paraffins comes up out of a well and cools. As they cool, the waxes and paraffins will come out of solution and gradually plate the bore of the tubing. If the fluid flow can be kept warm enough, the waxes and paraffins will not come out of solution and not plate out on the bore of the tubing string.

Once formed, these deposits can restrict the flow from the oil or gas well, or in some cases completely block the flow causing economic loss of production and high expenses for remediation.

BRIEF SUMMARY OF THE INVENTION

The object of this invention is to provide a method for controlling the uncontrolled flow of oil and gas from a well.

A second object of the present invention is to provide a method for preventing a buildup of hydrates within the bore of a tubing string.

A third object of the present invention is to provide a method for removing hydrate, wax or paraffin buildup within the bore of a tubing string.

Another object of the present invention is to provide a method for automatic closing of a safety valve upon loss of the electric signal that is used to heat the fluids within the well bore.

DETAILED DESCRIPTION OF THE INVENTION

Figure 1:
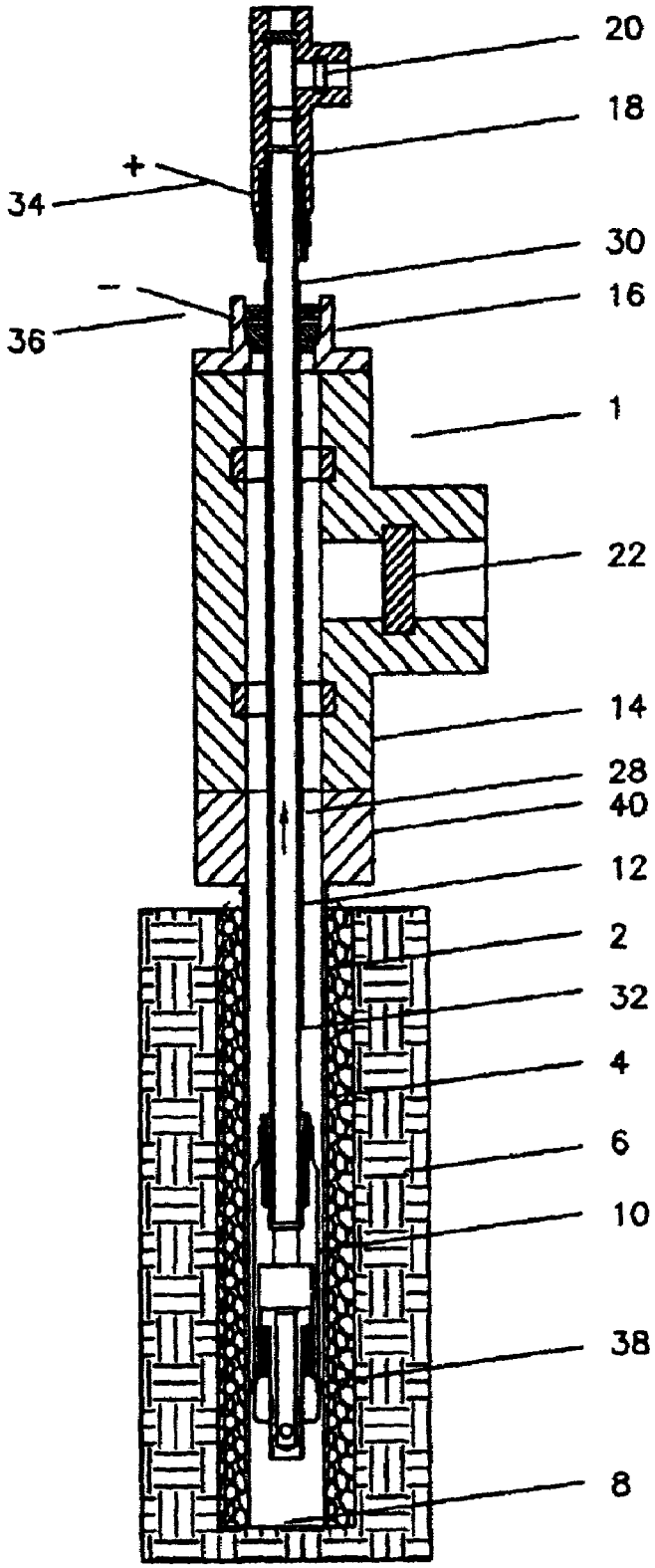
FIG. 1 is a half section of the present invention showing a set of apparatus of this invention from the top of the surface equipment to the bottom of the oil or gas well.

FIG. 1 shows an oil or gas well 1 with a casing or tubing 2 cemented with cement 4 into the earth 6 and terminating at 8 in a reservoir of oil or gas. Casing or tubing 2 is a graphic representation of the normal tubing and casing strings in an oil or gas well. Subsurface safety valve 10 is suspended from tubing string 12 which passes thru surface Christmas tree 14 and sealing flange 16 and terminates at control head 18. In this case the control head 18 acts as an upper Christmas tree with outlet valve 20 which replaces the normal outlet or wing valve 22.

Sealing flange 16 is bolted to the top of Christmas tree 14 and seals around the tubing string 12. Tubing string 12 is coated with a plastic like insulating material 28 from 30 to 32 to allow it to be run thru the casing or tubing 2 without being electrically shorted out to the casing or tubing 2. Electrical current is impressed at 34 to make an electrical circuit down the tubing string 12 thru the subsurface safety valve 10, across contacts 38, back up the tubing or casing 2 and out at the sealing flange 36. The sealing flange 36 and the coating 28 provide an electrical insulation between the Christmas tree 14 and the tubing string 12. The contacts 38 are illustrated as similar to a wire brush, but can be various kinds of contacts such as metal drag shoes.

As the tubing string 12 is of a relatively small cross section in comparison to the casing or tubing 2, the electrical resistance of the tubing string 12 is much greater and therefore the heat generated by the flow of electricity if greater in the tubing string 12.

As the electrical current flows across the subsurface safety valve 10, the valve is held in the open position. When the electrical current is cut off or fails for any reason, the subsurface safety valve automatically closes, preventing the uncontrolled loss of production fluids to the environment.

FIG. 1 generally shows the conditions when a well already exists and the features of the invention need to be retrofitted to the well. When conditions permit such as in a new installation or a major workover operation, the function of the seal flange 16 can be performed by a sealing hanger generally in the location of flange 40. In this arrangement, the valves of the original Christmas tree can be utilized to control the well.

Figure 2:
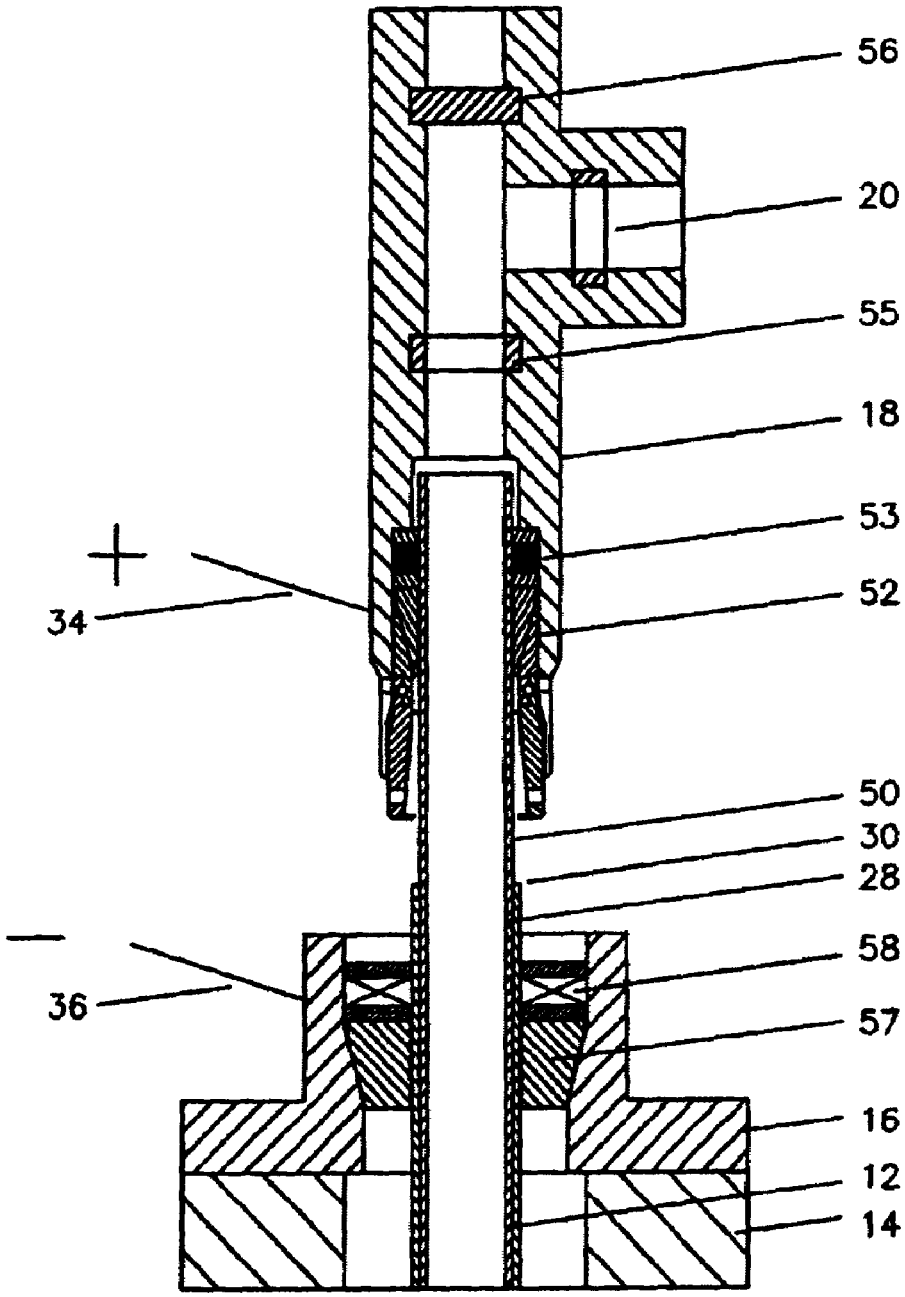
FIG. 2 is a half section of the upper portion of the apparatus shown in FIG. 1.

Referring now to FIG. 2, it can be seen that the end of tubing 12 has a portion 50 which is not covered with the plastic insulating coating 28. Control head 18 uses slips 52 to engage the tubing 12 and seal 53 to seal against the tubing 12. The control head 18 provides the normal valve function of a standard Christmas tree, the master valve 55, the swab valve 56, and the wing valve 20. Sealing flange 16 has slips 57 and seal 58 which support the control head, provide electrical contact, and seal the control head to the coiled tubing 12

Figure 3:
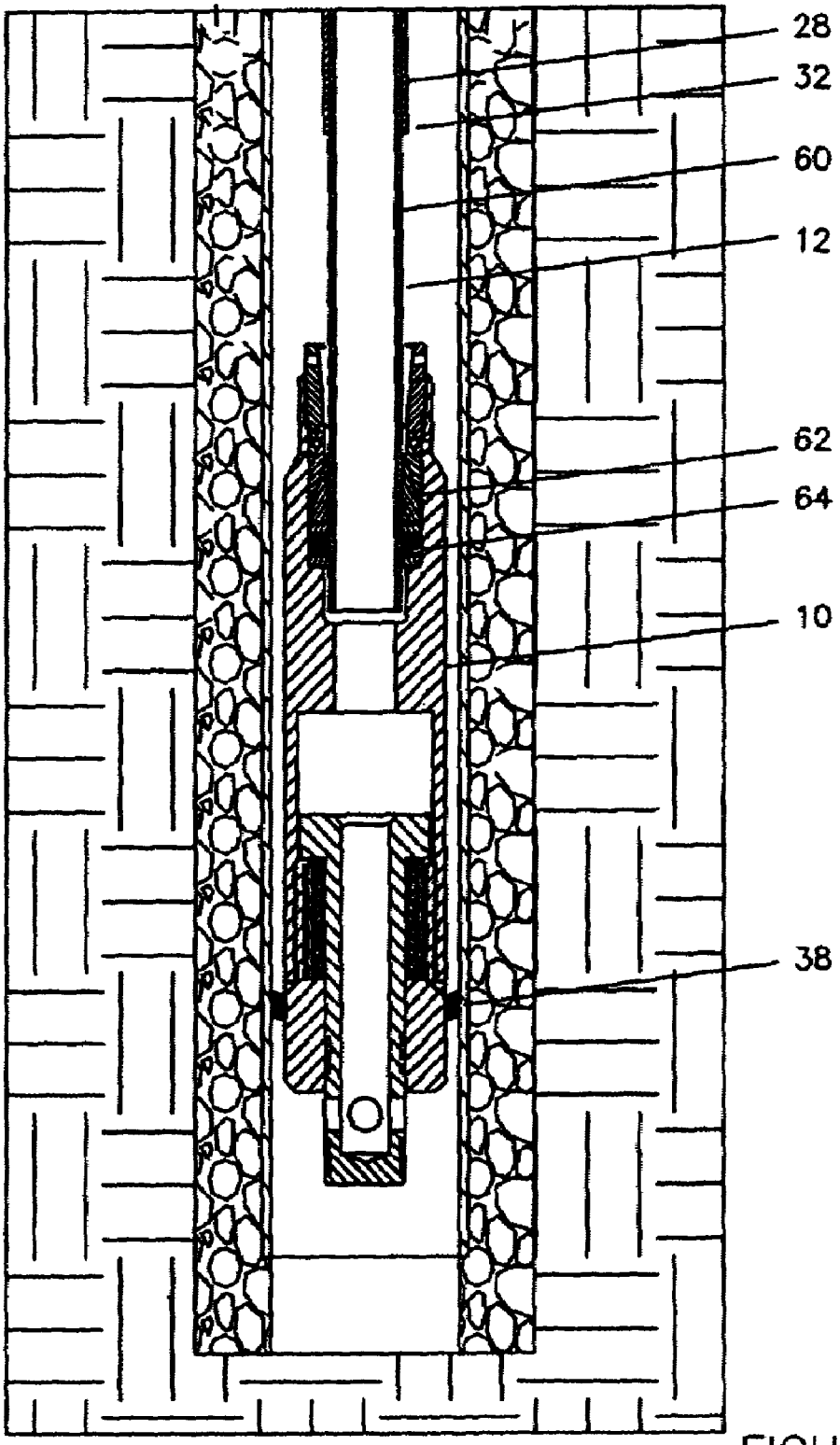
FIG. 3 is a half section of the lower portion of the apparatus shown in FIG. 1.

Referring now to FIG. 3, the lower end of FIG. 1 is shown with a portion 60 of tubing 12 without the insulating material 28 in place. Portion 60 is engaged by slips 62 and seal 64 to affix the subsurface safety valve 10 to the tubing 12.

Figure 4:
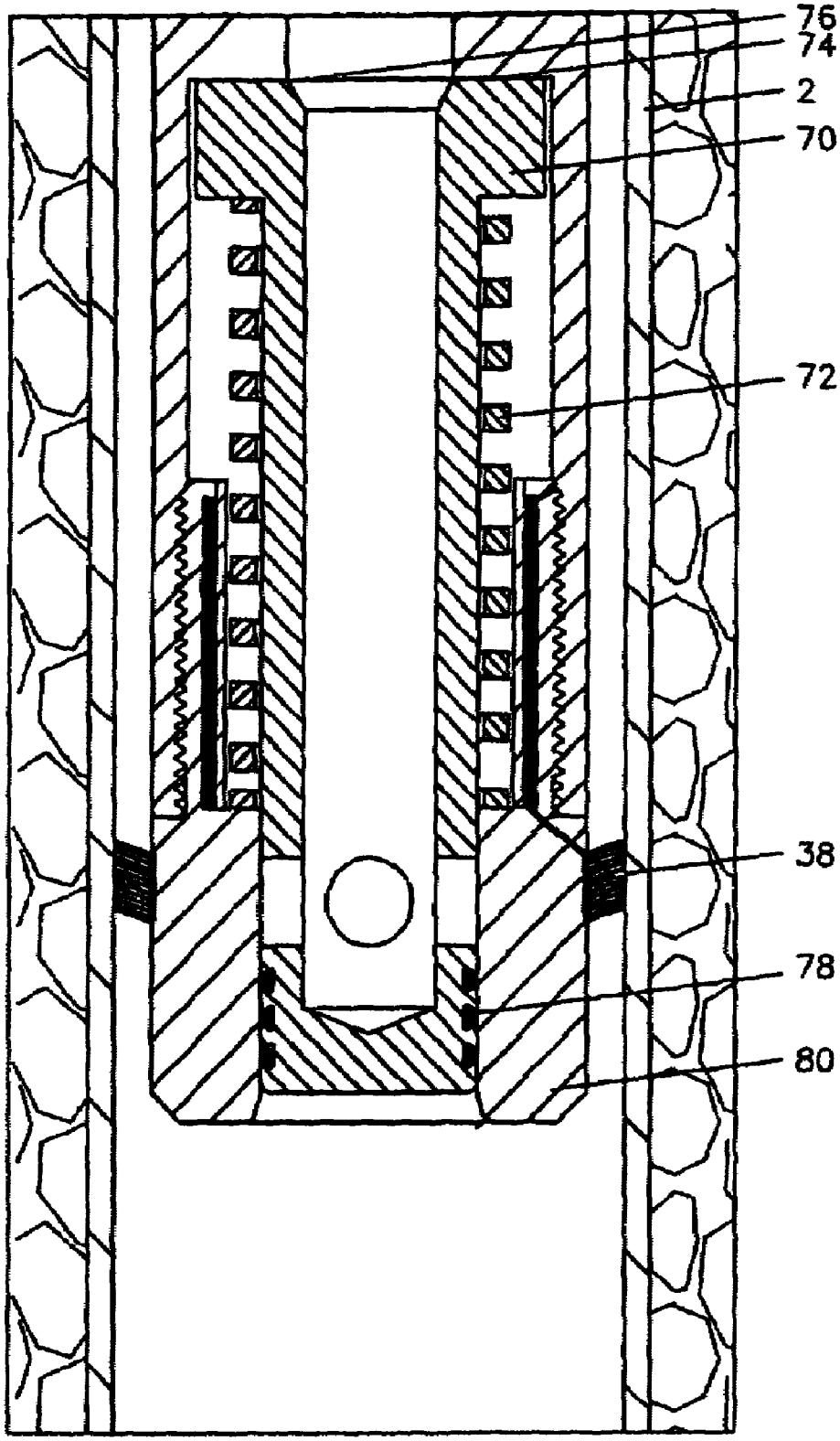
FIG. 4 is a half section of the safety valve portion of the lower portion of the apparatus shown in FIG. 1 with the safety valve closed.
Figure 5:
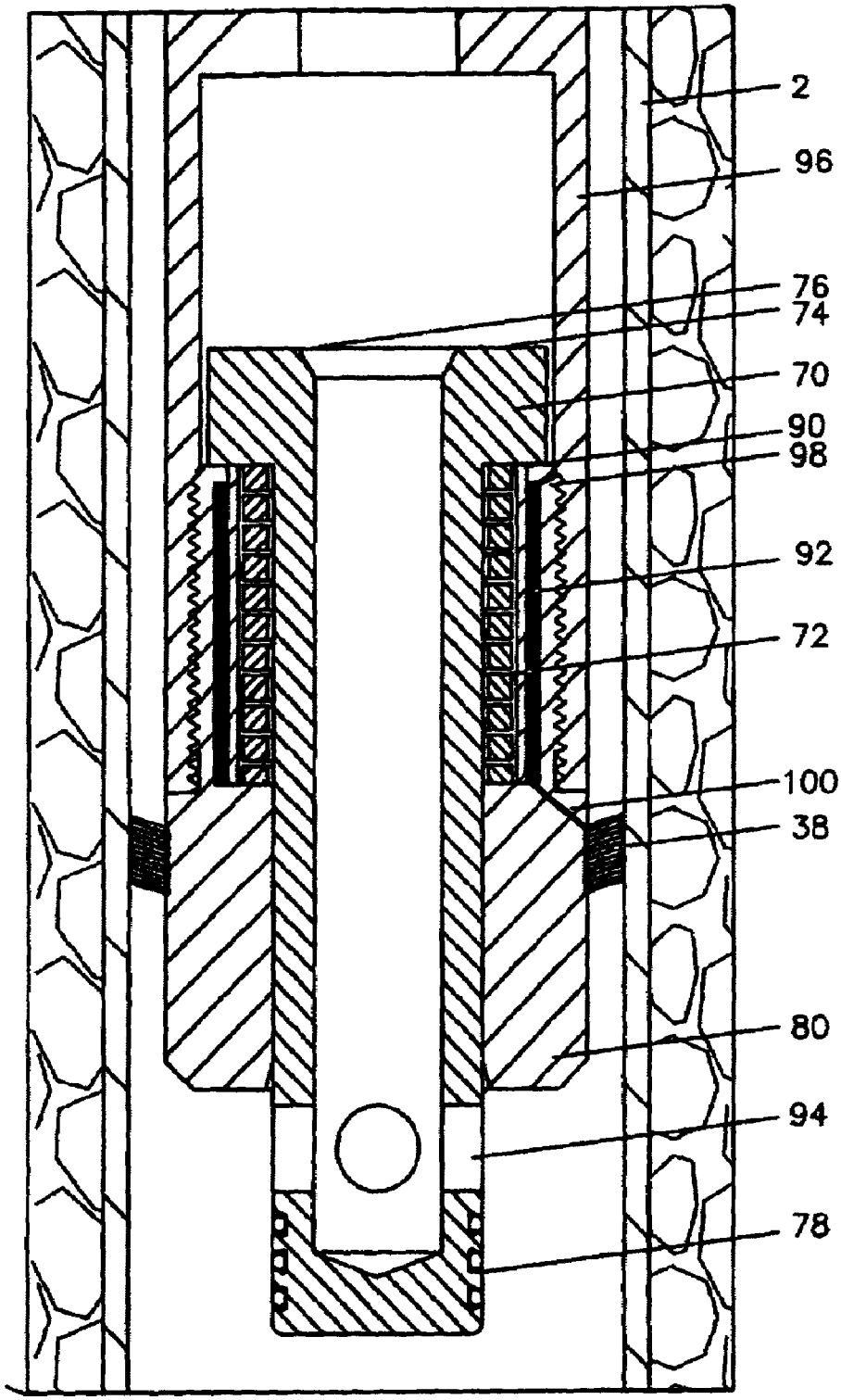
FIG. 5 is a half section of the safety valve portion of the lower portion of the apparatus shown in FIG. 1 with the safety valve opened.

Referring now to FIG. 4, the lower portion of FIG. 3 is shown with valve 70 being urged upwardly by spring 72 against shoulder 74 in the closed position. In this position, it will stop flow from below the valve 70 to above valve 70. Shoulder 76 is for receiving an insert such as a ball (not shown) to allow pressure from the surface to move the valve 70 downwardly to its open position as is shown in FIG. 5. Seals 78 seal valve 70 against the lower end of body 80.

Referring now to FIG. 5, the view of FIG. 4 is shown in the open position. Valve 70 has been pushed down against shoulder 90 and is retained in this position by the electromagnetic force from coil 92. Seals 78 are out of the bore in the body 80 and oil or gas is free to move from below valve 80 to above valve 80 thru holes 94 and to the surface. Electrical current is passed down thru upper body 96, thru connecting wire 98, thru coil 92, thru connecting wire 100, thru contactors 38, and up the tubing or casing 2. As long as the electrical current is present, the valve 12 will be "latched" open. When the electrical current is interrupted, the spring 72 will push the valve 12 up and close the subsurface safety valve.

The method of opening and holding the valve 12 open are illustrated to be by hydraulic opening and electromagnetic latching. Alternate methods are anticipated such as using an electric motor for the power source.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. The method of operating a subsurface safety valve in an oil or gas well comprising:

coating the external area of the intermediate portion of a string of tubing to electrically insulate said intermediate portion of said string of tubing, inserting said surface control valve into a well bore pipe on the string of tubing, electrically grounding said surface control valve to said well bore pipe, communicating an electrical signal from the surface along said string of tubing, to said surface control valve, and along said well bore pipe back to said surface, and closing said surface control valve upon the interruption of said electrical signal, opening said subsurface control valve by hydraulic flow within said tubing string, and dropping an insert from said surface to said surface control valve to assist in the opening of said surface control valve.

2. The method of claim 1, wherein said insert is a ball.

3. The method of claim 1, wherein said insert will dissolve in the fluids in the well bore.

4. The method of claim 1, wherein said insert will fall into a receptacle out of the fluid flow after said surface control valve is opened.

5. The method of preventing the formations of hydrate, wax, or paraffin solids in the well bore of an oil or gas well comprising:

coating the external area of the intermediate portion of a string of tubing to electrically insulate said intermediate portion of said string of tubing, inserting said string of tubing into said well bore pipe, electrically grounding the lower end of said string of tubing to said well bore pipe, communicating an electrical signal from the surface along down said string of tubing and along said well bore pipe back up to said surface, and using the electrical resistance of said string of tubing to heat the wall of said string of tubing, using said heated wall of said string of tubing to heat the fluids within the bore of said string of tubing to keep said fluids at a high enough temperature to prevent the formation of hydrate, wax, or paraffin solids inserting a surface control valve into a well bore pipe on said string of tubing, closing said surface control valve upon the interruption of said electrical signal, opening said subsurface control valve by hydraulic flow within said string of tubing and, dropping an insert from said surface to said surface control valve to assist in the opening of said surface control valve.

6. The method of claim 5, wherein said insert is a ball.

7. The method of claim 5, wherein said insert will dissolve in the fluids in the well bore.

8. The method of claim 5, wherein said insert will fall into a receptacle out of the fluid flow after said surface control valve is opened.

9. The method of operating a subsurface safety valve and preventing the formations of hydrate, wax, or paraffin solids in the well bore of an oil or gas well comprising:

coating the external area of the intermediate portion of a string of tubing to electrically insulate said intermediate portion of said string of tubing, inserting said surface control valve into a well bore pipe on a string of tubing, electrically grounding said surface control valve to said well bore pipe, communicating an electrical signal from the surface along said string of tubing, to said surface control valve, and along said well bore pipe back to said surface, closing said surface control valve upon the interruption of said electrical signal, using the electrical resistance of said string of tubing to heat the wall of said string of tubing, opening said subsurface control valve by hydraulic flow within said string of tubing, and dropping an insert from said surface to said surface control valve to assist in the opening of said surface control valve.

10. The method of claim 9, wherein said insert is a ball.

11. The method of claim 9, wherein said insert will dissolve in the fluids in the well bore.

12. The method of claim 9, wherein said insert will fall into a receptacle out of the fluid flow after said surface control valve is opened.

* * * * *